US007758297B2

(12) United States Patent
Fiala

(10) Patent No.: US 7,758,297 B2
(45) Date of Patent: Jul. 20, 2010

(54) METHOD FOR FLOW OPTIMIZATION IN MULTI-STAGE TURBINE-TYPE MACHINES

(75) Inventor: Andreas Fiala, Munich (DE)

(73) Assignee: MTU Aero Engines GmbH, Munich (DE)

( * ) Notice: Subject to any disclaimer, the term of this patent is extended or adjusted under 35 U.S.C. 154(b) by 402 days.

(21) Appl. No.: 11/431,365

(22) Filed: May 10, 2006

(65) Prior Publication Data

US 2006/0257238 A1 Nov. 16, 2006

(30) Foreign Application Priority Data

May 10, 2005 (EP) ..... 05010100

(51) Int. Cl.
*F01D 5/14* (2006.01)

(52) U.S. Cl. ..... 415/1; 415/199.5

(58) Field of Classification Search ..... 415/1, 415/23, 199.4, 199.5, 199.6
See application file for complete search history.

(56) References Cited

U.S. PATENT DOCUMENTS

| | | | | |
|---|---|---|---|---|
| 3,347,520 | A * | 10/1967 | Oweczarek | 415/119 |
| 5,486,091 | A * | 1/1996 | Sharma | 415/194 |
| 6,527,503 | B2 * | 3/2003 | Spano et al. | 415/1 |
| 6,540,478 | B2 * | 4/2003 | Fiala et al. | 415/194 |

FOREIGN PATENT DOCUMENTS

| | | |
|---|---|---|
| DE | 102 37 341 | 2/2004 |
| EP | 0 756 667 B1 | 6/1998 |
| EP | 1 201 880 B1 | 5/2002 |
| EP | 1 201 877 B1 | 9/2004 |
| JP | 54 114618 | 9/1979 |

OTHER PUBLICATIONS

Frank Hummel, "Wake-Wake Interactions and Its Potential for Clocking in a Transonic High Pressure Turbine", ASME Paper Nr. 2001-GT-302, 2001, pp. 1 to 9, XP 009053708.

* cited by examiner

*Primary Examiner*—Edward Look
*Assistant Examiner*—Nathaniel Wiehe
(74) *Attorney, Agent, or Firm*—Davidson, Davidson & Kappel, LLC

(57) ABSTRACT

A method for flow optimization in multi-stage turbine-type machines in which the inflow of a third of three consecutive blade rings is optimized, the first and the third blade ring having the same number of blades being situated on the same unit, rotor or stator, the second blade ring being situated on the other of the two units, rotor or stator, and an operating state, occurring during a high proportion of the operating time, being selected by ascertaining or predefining the appropriate operating parameters. In this operating state, the maxima of the obstruction, periodically occurring in the area of the outlet edges of the blade profiles of the second blade ring, are deflected onto the inlet edges of the blade profiles of the third blade ring within a predefined tolerance angle; the positions or the geometries of blade profiles of at least one of the three blade rings are modified as needed.

4 Claims, 4 Drawing Sheets

METHOD FOR FLOW OPTIMIZATION IN MULTI-STAGE TURBINE-TYPE MACHINES

This application claims priority to EP 05 010 100.5 filed May 10, 2005, the entire disclosure of which is hereby incorporated by reference.

FIELD OF THE INVENTION

The present invention provides a method for flow optimization in multi-stage turbine-type machines.

BACKGROUND

Methods for flow optimization in the area of three blade rings, of which the first and the third blade ring may be a guide blade ring or a rotating blade ring and the second blade ring may be, on the contrary, a rotating blade ring or a guide blade ring, are known from the related art.

For example, European Patent EP 0 756 667 B1 purports to describe a method according to the definition of the species for flow optimization in which the relative blade profile positioning between the first and the third blade rings is referred to as "clocking." The preferred application in this case is guide blade clocking, i.e., the first and the third blade ring are guide blade rings, whereas the second blade ring is a rotating blade ring. The principle of the method is that the flow paths of the wakes of the blade profiles of the first blade ring are ascertained up to the entry into the third blade ring and the inlet edges of the blade profiles of the third blade ring are positioned within a predefined tolerance angle range (25% of the blade pitch angle) relative to the inlet positions of the wakes. A direct/centered impact of each wake on the particular inlet edge should be the optimum. Each wake starts as a contiguous turbulent flow from the outlet edge of the blade profile of the first blade ring and is, on its way through the second rotating blade ring, divided into separate portions which move side by side on definite paths. The number of paths corresponds to the perimeter of the flow surface divided by the number of blades of the first blade ring. The moving portions of adjacent wakes of the first blade ring move on these paths in succession. According to the patent, the wake portions are averaged over time so that, mathematically, a contiguous wake is formed again which impacts the third blade ring. A further simplifying assumption of the patented method is that the flow of the wakes through the second blade ring should take place on only one flow surface and it is not taken into account that the wake also has a different configuration radially.

The accuracy and thus the precision of the method suffer from all these simplifying assumptions and approximations.

European Patent EP 1 201 877 B1 also relates to a method according to the definition of the species for flow optimization which is explained using the example of two guide blade rings, which are to be positioned relative to one another, with one rotating blade ring coaxially situated between them. During passage of the wakes of the first blade ring through the moving second blade ring, only the thermodynamic and hydrodynamic conditions on the intake side of the blade profiles of the second blade ring are considered. It is stated that the wake portions passing there interact with the blade boundary layer on the intake side and change in such a way that at least two zones, spaced from one another, are identifiable, these zones differing in at least one thermodynamic or hydrodynamic characteristic. The magnitude of the entropy is mentioned as a preferred discrimination criterion. However, it is also stated that there may be additional parameters, which differ in their magnitude, without specifying them in detail. In any event, one of the identified zones is to be selected and guided onto the intake edges of the blade profiles of the third blade ring. The at least one non-selected zone may fit in the blade profile space. Admittedly it may be necessary to analyze different parameters. It may also be necessary, for example, to guide first the zone of greater entropy and then the zone of smaller entropy onto the intake edges and to ascertain mathematically/experimentally which measure results in an increase in efficiency. This patent basically teaches a trial and error principle which compels those skilled in the art to adopt multiple different measures.

BRIEF SUMMARY OF THE INVENTION

In contrast, an object of the present invention is to propose a clear, unambiguous method for flow optimization in multi-stage turbine-type machines which offers a higher probability of success than the known methods.

According to the present invention, the sole deciding hydrodynamic criterion may be the obstruction, its periodically occurring maxima in the outlet area of the second blade ring and its flow paths up to the entry into the third blade ring being specifically ascertained.

These maxima should then—within a certain tolerance angle range—impact the inlet edges of the blade profiles of the third blade ring.

In accordance with an embodiment of the present invention, a method for flow optimization in multi-stage turbine-type machines is provided. In accordance with the method, an inflow of a third of three consecutive blade rings is optimized. A first and the third blade ring have a same number of blades and a same blade pitch angle and are coaxially situated on one of a rotor and a stator. A second blade ring is coaxially situated on the other one of the rotor and the stator such that during operation of the multi-stage turbine type engine a relative rotation takes place between the second blade ring and the first and third blade rings. The second blade ring located between the first and third blade rings.

With this in mind, the step of optimizing further comprises ascertaining or predefining appropriate operating parameters to select an operating state of the turbine-type machine, determining a tolerance angle in the operating state. The operating state has periodically occurring maxima of the obstruction ($V_{max}$) in an area of outlet edges of blade profiles of the second blade ring situated at a certain blade height, induced by wakes (N). The wakes originate from blade profiles of the first blade ring, and the maxima of the obstruction move from the area of outlet edges of the blade profiles of the second blade ring to an area of inlet edges of blade profiles of the third blade ring and deflect onto the inlet edges of the blade profiles of the third blade ring within the tolerance angle. The optimizing step further comprises modifying positions or geometries of blade profiles of at least one of the first, second or third blade rings situated at the certain blade height until the tolerance angle is within a predefined tolerance angle.

BRIEF DESCRIPTION OF THE DRAWINGS

The present invention is subsequently explained in greater detail on the basis of the simplified drawing.

DETAILED DESCRIPTION OF THE PREFERRED EMBODIMENTS

When carrying out the method according to the present invention, displacement thickness δ* (delta star) and obstruction V are to be ascertained, among other things.

Figure 1:
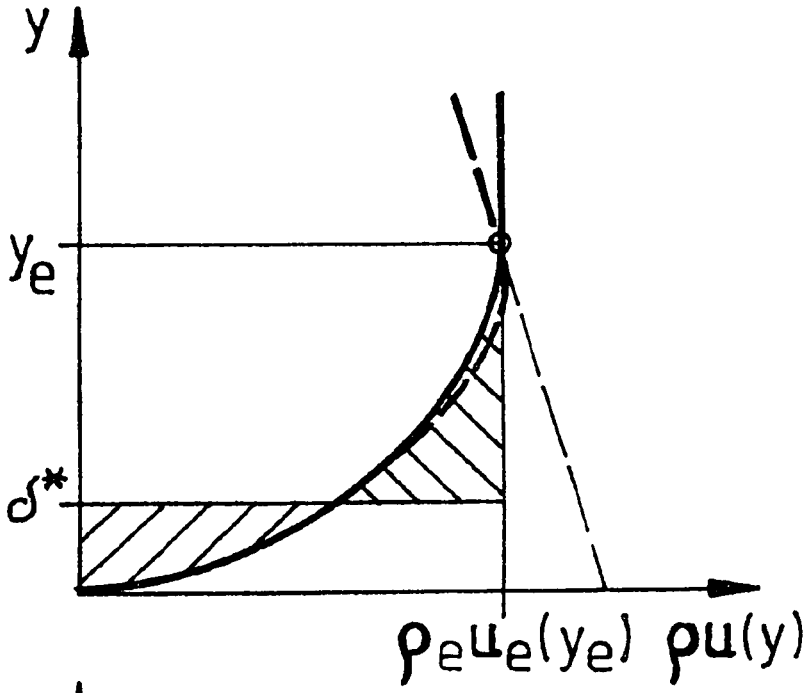
FIG. 1 shows a diagram for ascertaining the displacement thickness δ*.

In the form of a diagram, FIG. 1 shows the qualitative curve of flow density ρu (y) or, in the incompressible borderline case, the curve of the velocity u (y) of a flowing medium affected by friction in the area of a component surface, such as the surface of a blade profile around which the medium flows.

The y coordinate is selected to be at least approximately perpendicular to the flow direction and thus also approximately perpendicular to the component surface around which the medium flows.

In blade profiles, the y coordinate is preferably defined to be perpendicular to a local tangent of the surface of the blade profile. According to the no-slip condition, velocity u (y) on the component surface is "zero." With increasing distance from the component surface, flow density ρu (y) and velocity u (y) increase corresponding to a continuous curve up to a value $\rho_e u_e(y_e)$, where $y_e$ is the value at which the velocity no longer changes due to the viscous boundary layer. If the zero point of the y coordinate lies on the component surface, then value $y_e$ corresponds—at least fairly accurately—to the local boundary layer thickness. To continue the procedure, the flow density or velocity curve affected by friction is replaced by a friction-free curve having a constant flow density $\rho_e u_e$ or velocity $u_e$. For this purpose, the component surface is fictitiously displaced by the value of displacement thickness δ*, i.e., a blade profile is fictitiously thickened as appropriate. The same mass flow must result for the friction-free flow model as for the actual friction-affected flow. This results in the following definition for δ*:

$$\delta^* = \int_0^{y_e}\left(1 - \frac{\rho u(y)}{\rho_e u_e(y_e)}\right)dy, \text{ where } \rho_e u_e \text{ and } y_e \text{ are the corresponding values at the boundary layer edge.}$$

δ* is thus the y value whose horizontal line intersects flow density ρu(y) in such a way that below and above the δ* line between this curve and velocity curve ρu(y) two equal surfaces of the same size are enclosed. These two surfaces are diagonally hatched in opposite directions in FIG. 1. The surfaces are laterally delimited by the vertical y axis and a vertical line through $\rho_e u_e(y_e)$. This line does not have to be a vertical, but may be inclined to the y axis due to the change in the external velocity in the flow outside the boundary layers between the pressure side and the intake side. See the dashed curves in FIG. 1.

Since in periodic blade profiles of the blade ring rotating upstream, δ* periodically changes over time t, FIG. 1 is to be considered a "snapshot" taken at a certain point in time and at a certain location. For the present method, the time curve of δ* must be ascertained over at least one period for pressure side DS and intake side SS of the blade profile under consideration.

Figure 2:
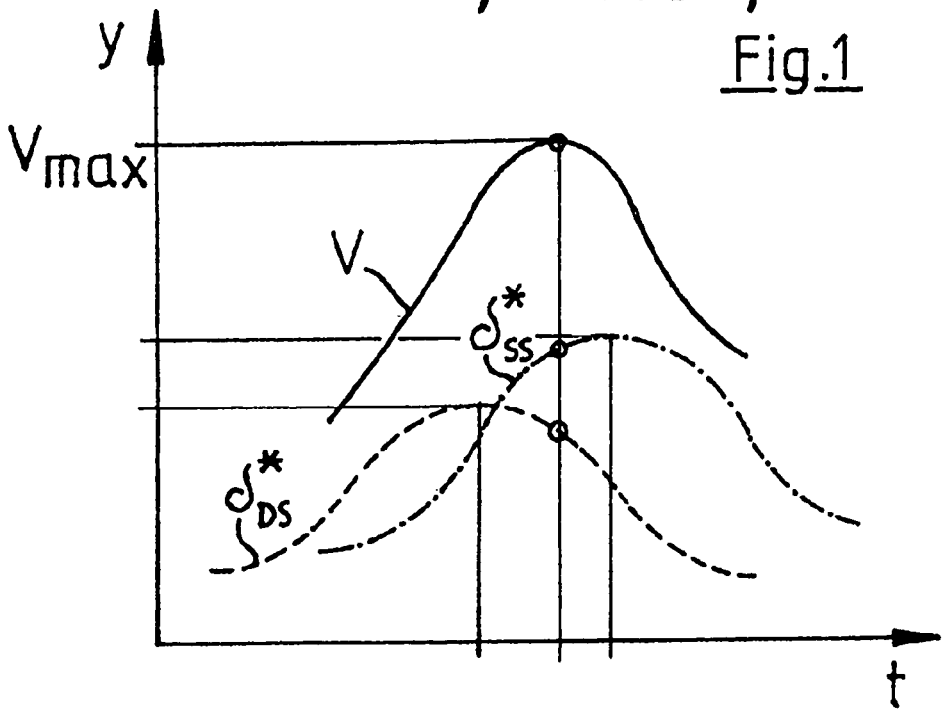
FIG. 2 shows a diagram for ascertaining the obstruction V.

FIG. 2 qualitatively shows how obstruction V is ascertained from the displacement thickness for pressure side $\delta^*_{DS}$ and the displacement thickness for intake side $\delta^*_{SS}$. The displacement thickness curves are plotted in the diagram over time axis t as positive quantities. It is apparent that the maxima of $\delta^*_{DS}$ and $\delta^*_{SS}$ differ in magnitude (height) and are offset in time against each other. The time curve of obstruction V results from the additive superposition of the curves of displacement thicknesses $\delta^*_{DS}$ and $\delta^*_{SS}$. Accordingly, the maximum of obstruction $V_{max}$ is chronologically between the time-offset maxima of the displacement thicknesses. It should be pointed out that the curves are actually rarely so constant and "harmonious" as shown, which, however, does not change anything in the method principle. The maximum of obstruction $V_{max}$ is presently to be determined in the area of the outlet edge of a blade profile and may alternatively be determined from the distribution perpendicular to wake N of the blade profile in the area downstream from the outlet edge. In the first case, the local blade profile thickness D is added to displacement thicknesses $\delta^*_{DS}$ and $\delta^*_{SS}$ as another additive quantity. Although the magnitude of the maximum of obstruction $V_{max}$ is increased by an at least approximately constant summand, the point in time of the maximum's occurrence remains unchanged, which is ultimately the determining factor for the precision of the method. The expression "in the area of the outlet edge of a blade profile" means the locale for determining the maximum of the obstruction may be selected to be close to the outlet edge within the blade profile, directly at the outlet edge, or close to the outlet edge downstream from the blade profile. Of importance is that the further path of the obstruction's maximum is correctly determined.

Figure 3A:
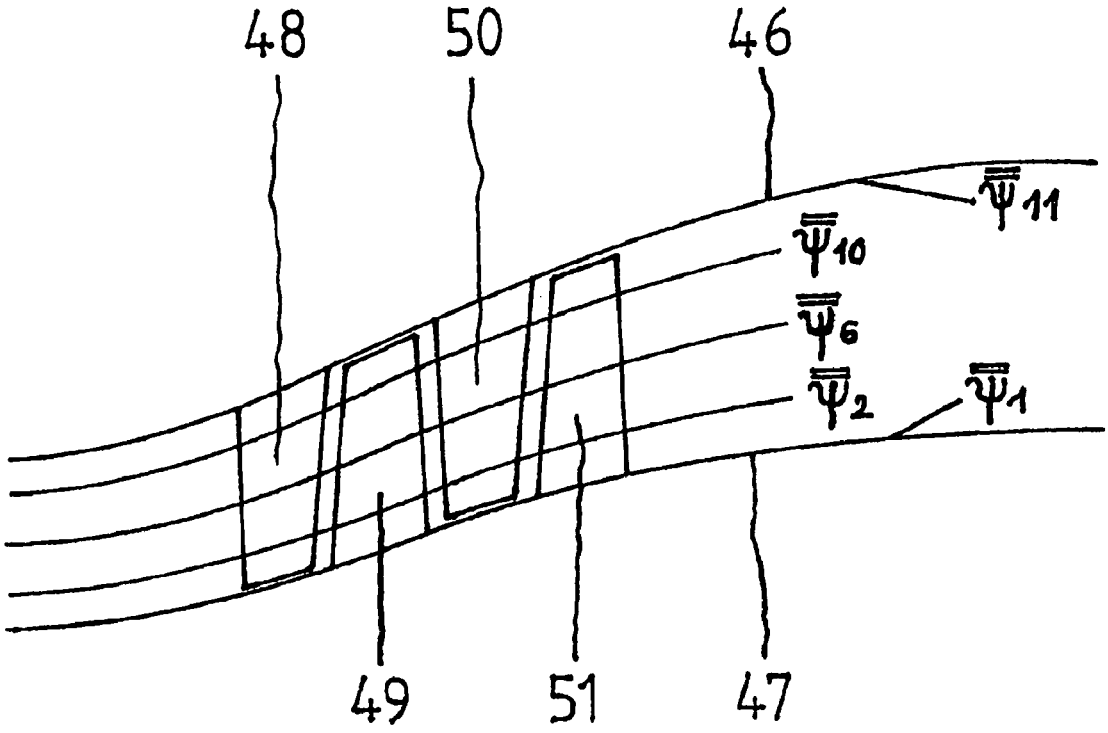
FIG. 3*a* shows the position of rotation flow surfaces in a bladed flow channel including a rotating hub and a stationary housing.

FIG. 3*a* shows a longitudinal section of a bladed flow channel including a stationary housing 46 and a rotating hub 47. Guide blade rings 48, 50 are situated on housing 46; rotating blade rings 49, 51 rotate with hub 47. Only the curvilinear contour of housing 46 and hub 47, which delimits the flow channel, is shown. Three additional curved lines can be seen within the flow channel. These lines are lines of intersection of three rotational flow surfaces $\overline{\psi_2}$, $\overline{\psi_6}$ and $\overline{\psi_{10}}$ with the selected axial-radial plane of intersection. The flow surfaces correspond to the spatial moving paths of selected "fluid particles."

Since, as a rule, these are unsteady flows, it may be sensible or necessary to simplify the relationships by averaging. The position of multiple rotational flow surfaces $\overline{\psi(z)}$ of the time-averaged and size-averaged 3D RANS flow field solution is depicted here in this sense. RANS stands for Reynolds Averaged Navier Stokes. At the edge of the flow channel, the contours of housing 46 and hub 47 correspond to the particular rotational flow surfaces $\overline{\psi_1}$ and $\overline{\psi_{11}}$. For further considerations, selected rotational flow surfaces form the section surfaces which cut the blades at a defined height (z) and produce blade profile sections.

Figure 3B:
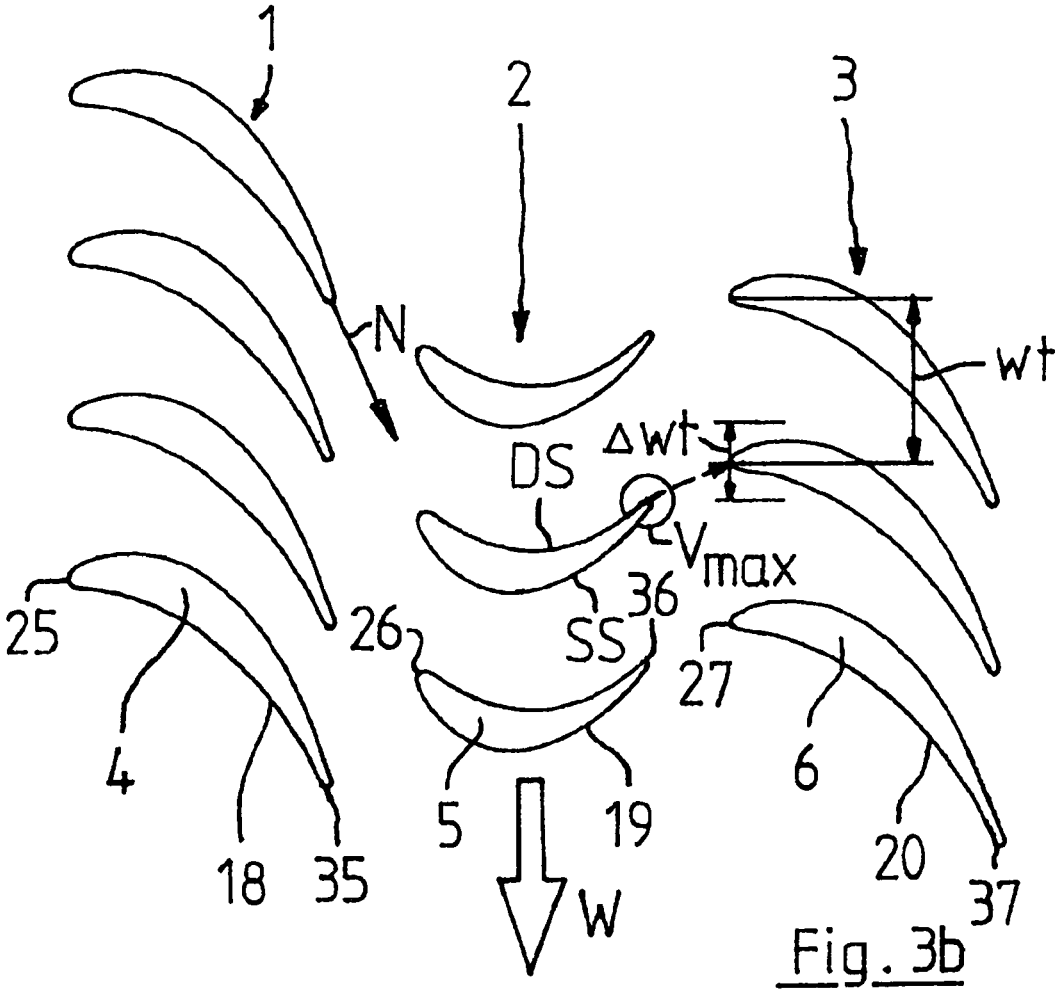
FIG. 3*b* shows blade profiles of three consecutive blade rings which are assigned to one another in a defined manner.

FIG. 3*b* shows the implementation of the principle of the method on the hardware, i.e., on blade rings which are hydraulically arranged in series. The medium flows here from left to right, i.e., from blade ring 1 to blade ring 3. Three adjacent blade rings 1 through 3 are thus considered, of which first blade ring 1 and third blade ring 3 belong to the same "stator" or "rotor" unit. Second blade ring 2 belongs to the respective complementary "rotor" or "stator" unit. There is no relative movement during operation between blade ring 1 and blade ring 3, whereas a relative rotation at constant velocity W takes place during operation between blade ring 2 and the two other blade rings 1 and 3. In the example of FIG. 3*b*, blade rings 1 and 3 should belong to the stator, i.e., they should be guide blade rings. Blade ring 2 should belong to the rotor, i.e., it should be a rotating blade ring. For the sake of better clarity, the representation in FIG. 3*b* shows only blade profiles 18, 19, 20 of blades 4, 5, 6 on a certain flow surface, i.e., in a flow plane section. The inlet edges of blade profiles 18, 19, 20 carry reference numerals 25, 26, 27 and the outlet edges reference numerals 35, 36, 37. Upstream blade profiles 18 generate wakes N, i.e., flow areas with turbulences and reduced velocity in the desired flow direction due to friction. The direction of movement of each wake N has a peripheral component and a meridional component which in turn may be made up of an axial component and a radial component, so that each wake N reaches the area of moving second blade ring 2 and is divided into separate portions by its consecutive blade profiles 19, the separate portions moving through the flow channels between blades 5 and interacting with the boundary layers on the pressure side and the intake side of blade profiles 19.

According to the present invention and in the approach according to FIGS. 1 and 2, periodically occurring maxima of obstruction $V_{max}$, are to be detected in the area of outlet edges 36 of blade profiles 19 in terms of locale and time. After leaving outlet edge 36, the further path of the respective maximum of obstruction $V_{max}$, is to be tracked up to the area of inlet edges 27 of blade profiles 20 of third stationary blade ring 3. The maximum of obstruction $V_{max}$ should impact an inlet edge 27 within a predefined tolerance angle Δ wt. This tolerance angle is, for example, ±15% of the blade pitch angle wt of third blade ring 3, i.e., it extends on both sides of inlet edge 27 15% in the circumferential direction. The total angle range is thus 30% of the blade pitch angle wt of third blade ring 3. If the measurements and calculations show that the maximum of obstruction $V_{max}$ actually impacts the inlet edges of third blade ring 3 within the predefined tolerance angle Δwt, then the intended flow optimization is achieved.

If this is not the case, geometric modifications must be made on at least one of blade rings 1, 2, 3 until the above-mentioned criterion is met.

For example, one modification could be a relative twist of blade rings 1 and 3, i.e., a relative limited angle movement in the circumferential direction around the longitudinal central axis of the blade rings.

It must be ensured after optimization that the relative position is not unintentionally changeable during disassembly and assembly or during operation. Another modification could be is the axial displacement of at least one of blade rings 1, 2, 3; however, an axial displacement of blade ring 1 relative to blade ring 2 is preferred. The same effect is achieved by axially displacing the blade profiles relative to their carrier, i.e., relative to the disk, the hub, the shroud band, etc. This is as a rule associated with extensive constructive modifications.

Those skilled in the art understand that, as a rule, the present optimization method can be carried out not only on a radial flow surface, i.e., in a flow plane section, but rather in multiple flow plane sections distributed over the radial extension of the turbine blade.

This is particularly true for distinctly "three-dimensional" blades having highly varying flow plane sections and a great radial extension.

Geometrical modifications of blades, which may be used in the present optimization method, are explained on the basis of FIGS. 4 through 8.

Figure 4:
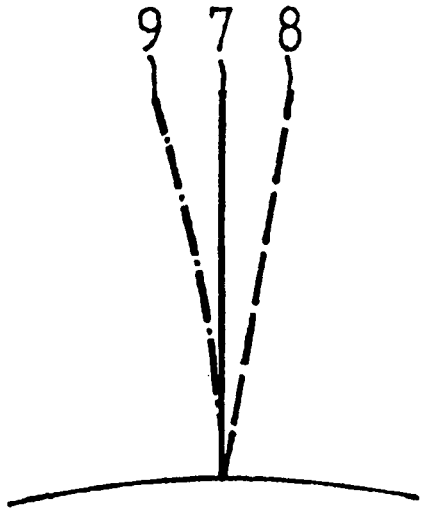
FIG. 4 shows three geometrically different blade edge lines viewed in the axial direction.

FIG. 4 shows an axial view onto stator trailing edges of blades 7, 8, 9 which start from a shared root area but are different over their radial height. Blade 7 depicted by a solid line runs straight and radially, i.e., more conventionally "threaded," i.e., the profile sections are placed in the same circumferential position on each trailing edge.

Blade 8 depicted by a dashed line runs straight, but with an inclination in the circumferential direction. This also referred to as "lean." Blade 9 depicted by a dash-dotted line has a curvature in the circumferential direction, which is referred to as a "bow." A relative circumferential displacement of the profile sections, which are situated radially on top of one another, is de facto achieved using such modifications.

Figure 5:
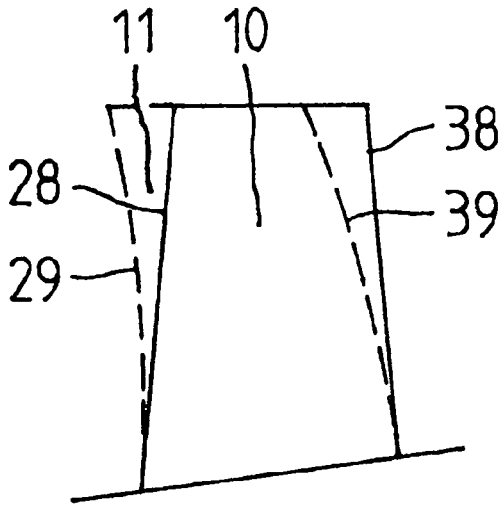
FIG. 5 shows two geometrically different blades viewed in the circumferential direction.

FIG. 5 shows two rotor blades 10, 11 viewed in the circumferential direction. Blade 10 with inlet edge 28 and outlet edge 38, depicted by a solid line, has a trapezoidal, rather conventional, profile. Blade 11, depicted by a dashed line, has an axially curved inlet edge and an equally axially curved outlet edge 39. This is also referred to as an "axial bow" or a "sweep" and primarily causes a relative displacement of the profile sections in the axial direction.

Figure 6:
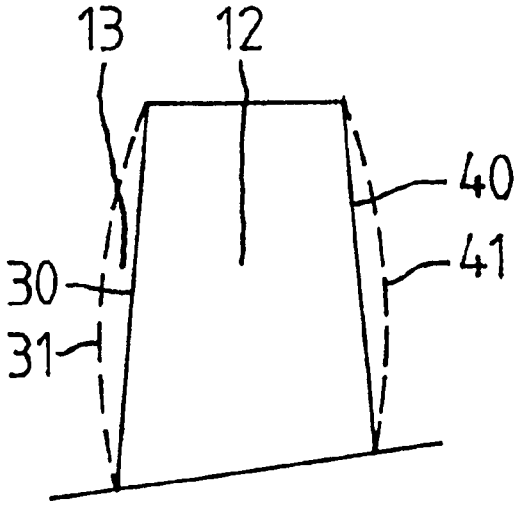
FIG. 6 shows two geometrically different blades viewed in the circumferential direction.

FIG. 6 shows two blades 12, 13 viewed in the circumferential direction. Blade 12 having inlet edge 30 and outlet edge 40, depicted by a solid line, corresponds in its trapezoidal, conventional profile to blade 10 in FIG. 5. Blade 13, depicted by a dashed line, shares the blade root and the blade tip with blade 12. However, its inlet edge 31 and its outlet edge 41 are bent outward in opposite directions so that a convex blade profile is created.

This measure is also referred to as "barreling." The axial length of the profile sections is primarily increased thereby, the increase being most pronounced in the area of the central radial height. In addition to the blade root and the blade tip, any other profile section may be shared.

Figure 7:
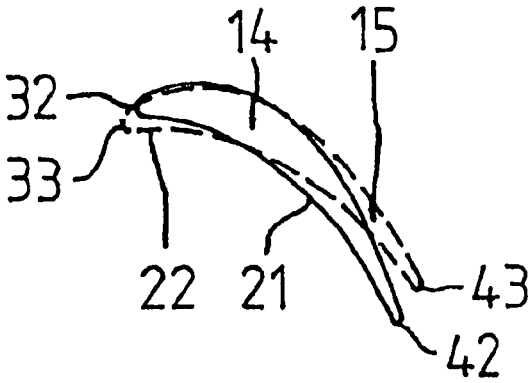
FIG. 7 shows two blade profiles, rotated with respect to each other but otherwise identical.

FIG. 7 shows a profile section through two blades 14, 15 having identical blade profiles 21, 22 in different positions. The inlet edges are indicated by the numerals 32, 33, and the outlet edges by 42, 43.

Blade profile 22, depicted by a dashed line, should be twisted with respect to blade profile 21, depicted by a solid line, about the thread axis (not shown here). Inlet edge 32 and outlet edge 42 of blade 21 are thus more offset than inlet edge 33 and outlet edge 43 of blade 22. This measure is also referred to as a "twist." The twist causes a change in the direction of the inlet flow as well as the outlet flow of such a blade set.

Figure 8:
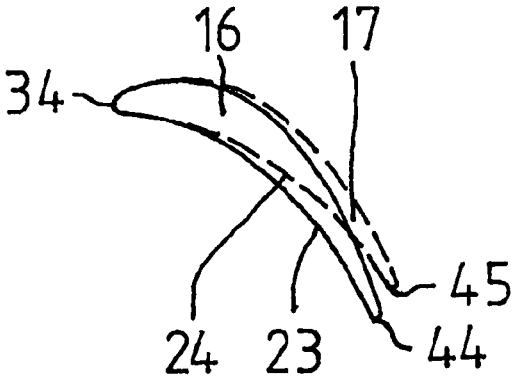
FIG. 8 shows two geometrically different blade profiles.

Finally, FIG. 8 shows a profile section through two blades 16, 17 having an identical inlet flow and different outlet flows. Both blade profiles 23 and 24 have a shared inlet edge 34 and a shared "nose contour." Due to a greater profile curvature, blade profile 23, depicted by a solid line, also causes a greater flow deflection up to its outlet edge 44. Blade profile 24, depicted by a dashed line, deflects the flow up to its outlet edge to a lesser extent. This measure is also referred to as "vortexing."

Without claiming completeness, the above-mentioned measures for flow change are suitable individually or in many combinations to implement the optimization criterion according to the present invention.

What is claimed is:

1. A method for flow optimization in multi-stage turbine-type machines comprising the steps of:

optimizing an inflow of a third of three consecutive blade rings, a first and the third blade ring having a same number of blades and a same blade pitch angle and being coaxially situated on one of a rotor and a stator, a second blade ring coaxially situated on the other one of the rotor and the stator such that during operation of the multi-stage turbine type engine a relative rotation takes place between the second blade ring and the first and third blade rings, the second blade ring located between the first and third blade rings, the step of optimizing further comprising:

ascertaining or predefining appropriate operating parameters to select an operating state of the turbine-type machine, determining a tolerance angle in the operating state, wherein the operating state has periodically occurring maxima of the obstruction ($V_{max}$) in an area of outlet edges of blade profiles of the second blade ring situated at a certain blade height, induced by wakes (N), the wakes originating from blade profiles of the first blade ring, the maxima of the obstruction moving from the area of outlet edges of the blade profiles of the second blade ring to an area of inlet edges of blade profiles of the third blade ring and deflecting onto the inlet edges of the blade profiles of the third blade ring within the tolerance angle, wherein the determining step further includes ascertaining a magnitude of the obstruction in the area of the outlet edge of a blade profile of the second blade ring based on a displacement thickness δ* for a pressure side and an intake side of the blade profile, calculated using the equation:

$$\delta^* = \int_0^{y_e} \left(1 - \frac{\rho u(y)}{\rho_e u_e(y_e)}\right) dy$$

wherein ρ is a density of a flowing medium, u is a velocity of the flowing medium, y is a coordinate perpendicular to a reference line and e is an index for a boundary between the flow disturbed by a boundary layer and the flow undisturbed by the boundary layer.

2. The method as recited in claim 1 wherein the reference line is a tangent of a surface of the blade profile in the area of the outlet edge.

3. The method as recited in claim 2 wherein the magnitude of the obstruction is calculated as the sum of the instantaneous pressure-side and intake-side displacement thicknesses $\delta^*_{DS}$ and $\delta^*_{SS}$ and a blade profile thickness D in the area of the outlet edge of the blade profile using the following equation:

$$V=\delta^*_{DS}+\delta^*_{SS} \text{ or } V=D+\delta^*_{DS}+\delta^*_{SS}.$$

4. A method for flow optimization in multi-stage turbine-type machines comprising the steps of:

optimizing an inflow of a third of three consecutive blade rings, a first and the third blade ring having a same number of blades and a same blade pitch angle and being coaxially situated on one of a rotor and a stator, a second blade ring coaxially situated on the other one of the rotor and the stator such that during operation of the multi-stage turbine type engine a relative rotation takes place between the second blade ring and the first and third blade rings, the second blade ring located between the first and third blade rings, the step of optimizing further comprising:

ascertaining or predefining appropriate operating parameters to select an operating state of the turbine-type machine;

determining a tolerance angle in the operating state based on determining a maxima of the obstruction at an outlet edge of the second blade ring, wherein the operating state has periodically occurring maxima of the obstruction ($V_{max}$) in an area of outlet edges of blade profiles of the second blade ring situated at a certain blade height, induced by wakes (N), the wakes originating from blade profiles of the first blade ring, the maxima of the obstruction moving from the area of outlet edges of the blade profiles of the second blade ring to an area of inlet edges of blade profiles of the third blade ring and deflecting onto the inlet edges of the blade profiles of the third blade ring within the tolerance angle; and modifying positions or geometries of blade profiles of at least one of the first, second or third blade rings situated at the certain blade height until the tolerance angle is within a predefined tolerance angle;

wherein the determining the maxima of the obstruction at the outlet edges of the second blade ring includes determining a displacement thickness for a pressure side and an intake side of the blade profile.

* * * * *